US006579251B1

(12) United States Patent
Randoll

(10) Patent No.: US 6,579,251 B1
(45) Date of Patent: Jun. 17, 2003

(54) MASSAGE DEVICE HAVING AN OSCILLATING ACTIVE CONTACT SURFACE

(76) Inventor: Ulrich G. Randoll, Ettaler Strasse 46, 82194 Grobenzell (DE)

( * ) Notice: Subject to any disclaimer, the term of this patent is extended or adjusted under 35 U.S.C. 154(b) by 0 days.

(21) Appl. No.: 09/341,592

(22) PCT Filed: Jan. 23, 1998

(86) PCT No.: PCT/EP98/00369

§ 371 (c)(1),
(2), (4) Date: Jul. 13, 1999

(87) PCT Pub. No.: WO98/32409

PCT Pub. Date: Jul. 30, 1998

(30) Foreign Application Priority Data

Jan. 23, 1997 (DE) ..... 197 02 334

(51) Int. Cl.[7] ..... A61H 1/00
(52) U.S. Cl. ..... 601/89; 601/93
(58) Field of Search ..... 601/49, 50, 51, 601/53, 67–70, 72, 73, 80, 81, 82, 84, 85, 89, 93–95, 112, 113, 114, 118–123, 125, 126, 129, 130–136; D24/211–214

(56) References Cited

U.S. PATENT DOCUMENTS

| | | | | | |
|---|---|---|---|---|---|
| 3,030,967 | A | * | 4/1962 | Peyron | 601/89 |
| 3,128,761 | A | * | 4/1964 | Smith | 601/112 |
| 3,845,758 | A | * | 11/1974 | Anderson | 601/114 |
| 4,157,712 | A | * | 6/1979 | Gaynor | 601/125 |
| 4,813,404 | A | * | 3/1989 | Vallis | 128/57 |
| 4,984,569 | A | * | 1/1991 | Liu | 601/93 |
| 5,304,112 | A | * | 4/1994 | Mrklas et al. | 601/15 |
| 5,599,282 | A | * | 2/1997 | Ito | 601/94 |
| 5,904,660 | A | * | 5/1999 | Kim | 601/108 |

FOREIGN PATENT DOCUMENTS

| | | | | |
|---|---|---|---|---|
| DE | 4408867 | | 9/1995 | |
| DE | 4443756 | | 2/1996 | |
| DE | 19508791 | | 9/1996 | |
| DE | 19615793 | | 10/1997 | |
| FR | 2439584 | | 5/1980 | |
| GB | 2 279 257 A | * | 4/1995 | A61H/15/00 |
| WO | 96/23403 | | 8/1996 | |

* cited by examiner

*Primary Examiner*—Justine R. Yu
(74) *Attorney, Agent, or Firm*—Ostrolenk, Faber, Gerb & Soffen, LLP

(57) ABSTRACT

A versatile and highly effective massage device has an active surface for bringing into contact with tissue to be treated, and means for driving the active surface in an oscillating pivoting movement about an axis. The active surface has, in cross section, different radii perpendicular to the axis in different directions and can be rotated parallel to the axis in order to bring in each case different zones of the active surface into contact with the tissue.

15 Claims, 3 Drawing Sheets

MASSAGE DEVICE HAVING AN OSCILLATING ACTIVE CONTACT SURFACE

BACKGROUND OF THE INVENTION

The present invention relates to a massage device for treating acute and chronic microcirculation disorders in warm-blooded beings.

DE-A 4 408 867 discloses a massage device which, on a housing that can be held and guided in the hand, has an active surface which is connected to the housing so as to pivot about an axis. This active surface is cylindrical, the axis of rotation of the cylinder coinciding with the pivot axis. When the active surface is pressed against a body area that is to be treated, the skin touched by the active surface, and the underlying tissue, are set in oscillation by friction parallel to the body surface. The amplitude of the oscillation is predetermined here by the structure of the massage device.

DE 4 443 756 D1 describes a massage device with an active surface whose radius, measured from a pivot axis of the device, differs in different directions. This device is a large-format fixed device in which the patient places an entire body part such as the lower leg on the active surface, so that the body part to be treated essentially as a whole follows the movement of the active surface. Since the position of the patient relative to the device cannot be readily changed during treatment, the movement transmitted from the device to the body part to be treated is always the same during a treatment session.

SUMMARY OF THE INVENTION

The object of the present invention is to create a versatile and therapeutically highly effective massage device. According to the invention, this object is achieved with the features of claim 1. Advantageous embodiments are defined in the dependent claims.

The present invention makes it possible, by means of simply changing the orientation of the active surface of the massage device with respect to the tissue to be treated, to modify the amplitude of the pivoting movement. Surprisingly, this modulation of the amplitude permits a considerably longer-lasting and deeper therapeutic action, in the treatment of disorders associated with impaired microcirculation, than is possible with the conventional techniques. Tests revealed significant relief or even total disappearance of the symptoms, even in patients who did not respond to the conventional methods.

Indicated uses for the device according to the invention are therefore cases of painful or tensed musculature, musculoskeletal disorders of the nervous system, support and movement apparatus, chronic abuse of alcohol, medication and drugs, acute traumas, following surgical interventions, but also in cases of chronic diseases of the rheumatic type, psychiatric disorders, chronic fatigue syndrome, osteoporosis, multiple sclerosis, gout, diabetes, cellulite, Sudeck's syndrome, brain pressure, vertigo, Ménière's disease, circulation problems, pain, tumors, apoplexy, tactile and sensory hypesthesias and paresthesias, sensory stimulation, environmentally induced diseases and all changes affecting the matrix.

It is preferable that the radius of the active surface changes continuously over at least one area thereof. This makes it possible to exert on the tissue, in addition to the surface-parallel movement, an oscillating pressure of identical frequency. This pressure is not distributed uniformly over the patient's body surface contacted by the active surface, but instead increases in the direction of greater radii of the active surface. In this way, a pressure gradient is generated rhythmically in the tissue, by means of which tissue fluid is pumped through the tissue parallel to the surface. This pump action makes it possible to increase the throughput of body fluids such as blood or lymph through the treated tissue zones, and thus to significantly improve the supply of nutrients to the tissue and the breakdown of metabolic waste products.

The invention can be designed as a fixed device as well as a hand-guided device. A particular advantage of the hand-guided device is that the user can, with the same hand guiding the device, detect the hardened area of the treated tissue and, by simply turning the massage device about the axis of the active surface, adapt the amplitude of the massage movement to the detected degree of hardening or rhythmically vary the amplitude.

BRIEF DESCRIPTION OF THE DRAWINGS

Further features and advantages of the invention will be evident from the following description of illustrative embodiments, in which reference is made to the attached drawings, in which.

DETAILED DESCRIPTION OF THE INVENTION

Figure 1:
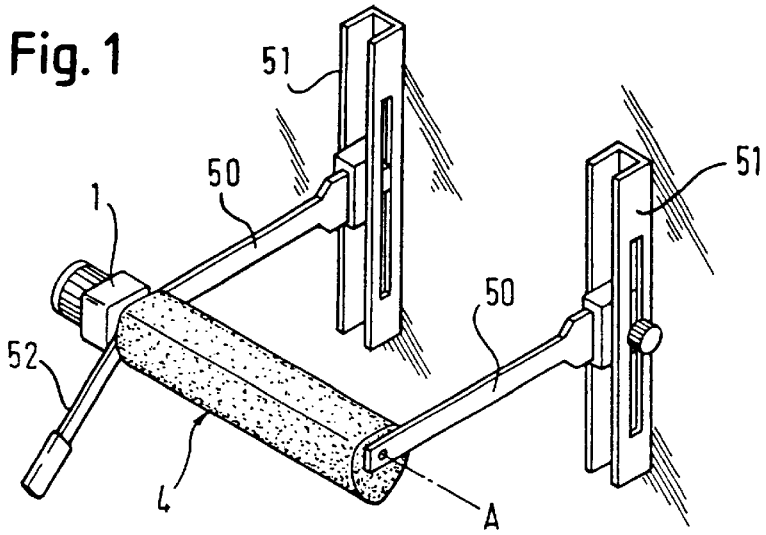
FIGS. 1 and 2 each show a perspective view of a massage device according to the invention.

The massage device shown in FIG. 1 is a fixed device which, with the aid of two arms 50, is mounted on rails 51 on the wall of a treatment room in such a way as to be vertically adjustable. At their ends, the arms 50 support a roller-shaped massage head 4 whose circumferential surface forms an active surface, and a housing 1 in which an electric motor is accommodated which drives the massage head in an oscillating pivoting movement about an axis A. The amplitude of the pivoting movement is chosen as a function of the mean radius of the head, such that a typical amplitude of a point on the surface of the head 4 is about 4 to 7 mm.

In order to treat the lower leg muscles, for example, a patient lies down on his or her back in front of the device and places the lower leg on the top of the massage head 4 which has been set at a suitable height.

The unit comprising housing 1 and massage head 4 can be rotated through an angle of up to 360° with the aid of a pivot arm about the axis A, so that different zones of the active surface of the head 4 can be brought into contact with the lower leg as desired, in order to set the latter in oscillations with differing amplitude depending on the radius of the zone.

In a variant of the device shown in FIG. 1, the rails 51 are not mounted on a wall, but on a moving carriage. Such a movable device is particularly suitable for treating bedridden patients.

Figure 2:
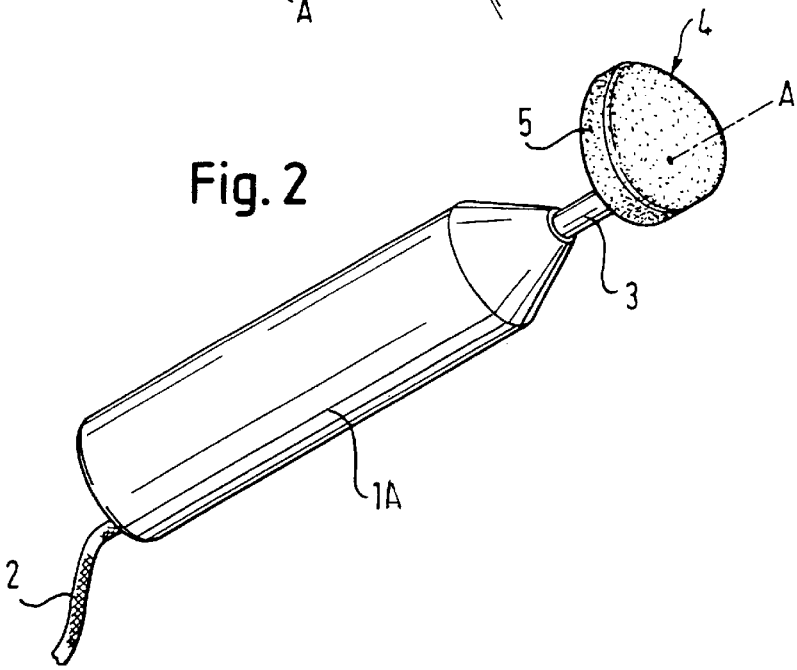

The massage device shown in FIG. 2 has a housing 1A which can be held and guided by hand and which has a diameter in the range of 3 to 8 cm. The housing 1A contains an electric motor which is powered via a supply cable 2 from a power supply (not shown). An eccentric gear in the housing 1A converts a rotary movement of the motor into an oscillating pivoting movement of a shaft 3. The shaft 3 supports a massage head 4 whose edge face forms an active surface 5 for placing on the skin of a patient. The contour of the active surface in a cross section perpendicular to the axis A is the same in the devices from FIGS. 1 and 2 and is shown more clearly in FIG. 3.

The active surface of the massage head shown there comprises two portions 10, 11 which are mirror-symmetrical to one another and which each have the form of an Archimedean spiral about the axis A. The two spirals intersect at a point which forms an area 12 of the active surface distant from the axis. An area tangential to the two spirals 10, 12 forms an area 13 near the axis.

The distance of the proximal area 13 from the axis A is about 3 to 10 mm, while that of the distant area 12 is 15 to 100 mm, preferably 20 to 50 mm.

Figure 4:
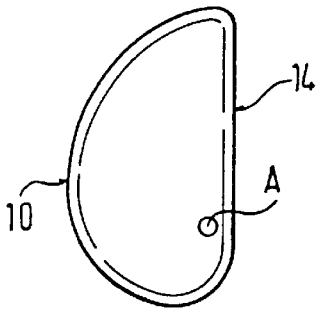

FIG. 4 shows a second embodiment of a massage head in cross section perpendicular to the axis A. Its active surface comprises only one spiral area 10 and a straight-line boundary area 14.

Figure 5:
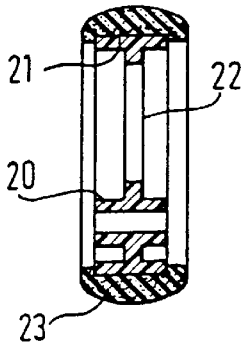
FIG. 5 shows a cross section through line 5—5 of FIG. 3.

FIG. 5 shows a treatment head in cross section parallel to the pivot axis A. Since the pivot axis A does not extend through the center of gravity of the massage head, the latter has an imbalance which can lead to the massage device not running smoothly, which is particularly inconvenient in the case of a hand-guided device. In order to counteract this, a counterweight can be provided on the shaft 3, if appropriate in the housing 1, to compensate for the imbalance of the massage head. Such a counterweight can also be incorporated in the massage head itself. However, in order to keep the imbalance small from the outset, the massage head should be light and constructed with a small moment of inertia. The massage head shown in FIG. 4 therefore comprises a sleeve 20 which is placed with a form fit on the shaft 3 and is secured releasably thereon, a circumferential surface 21 extending around the shaft, and a disk 22 which connects sleeve and circumferential surface. As long as the stability of the massage head so permits, the disk can be perforated or can be reduced to individual spokes. The sleeve 20, circumferential surface 21 and disk 22 are preferably made of a rigid plastic.

In a simple embodiment, the circumferential surface 21 can at the same time form the active surface of the massage head. In the embodiment shown in FIG. 4, however, it is provided with a covering 23 of a resilient material such as soft polyurethane, cellular rubber, textile or the like.

The mode of operation of the invention is explained with reference to FIG. 6. This figure shows three different phases in the pivoting movement of the massage head shown in FIG. 3. The height of the axis A above the skin 30 of the patient to be treated is the same in all three phases. In phase a, the massage head 4 is turned to the maximum extent in the clockwise direction, and there is no or only very little contact between the massage head and the skin 30 of the patient.

From this position, the massage head begins to pivot in the anticlockwise direction and first reaches a mid position b. In this position, the skin 30 and underlying muscle areas are displaced a few millimeters toward the right in the figure, and at the same time the tissue is compressed down. The combination of the pressure exerted from above on the tissue and its simultaneous displacement toward the right in the figure leads to a zone 31 forming toward the right underneath the massage head 4, in which zone 31 the pressure of the tissue fluid is increased. In phase c of the movement, in which the massage head 4 has reached its maximum deflection in the anticlockwise direction, this effect is intensified further, and the skin and tissue are visibly raised at 32. Since the path toward the left in the figure is obstructed by the massage head 4, tissue fluid can escape from the zone 31 preferably in the direction toward the right in the figure. In this way, a directed flow is achieved through the tissue, which greatly improves the supply to said tissue.

By running the device over the patient's limbs from distal to proximal, said limbs can be dewatered as a whole with the device according to the invention and the tissue can thus be made firmer and strengthened.

This effect can also be utilized for treating environmentally induced tissue damage. Thus, for example, it is known that the toxic heavy metal cadmium preferentially deposits in the connective tissue. By using the device according to the invention, preferably in conjunction with infusions, for example with physiological saline solution, such deposits can be flushed out and the affected tissue can be cleaned.

Figure 3:
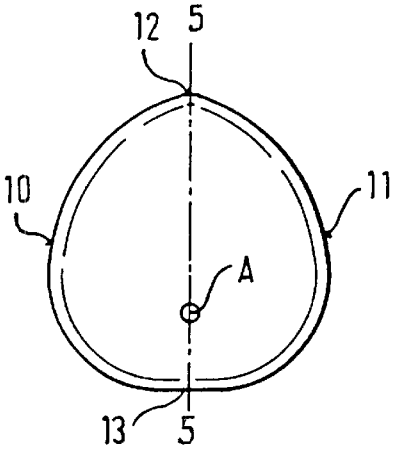
FIGS. 3 and 4 each show a plan view of a massage head of a massage device according to the invention.
Figure 6:
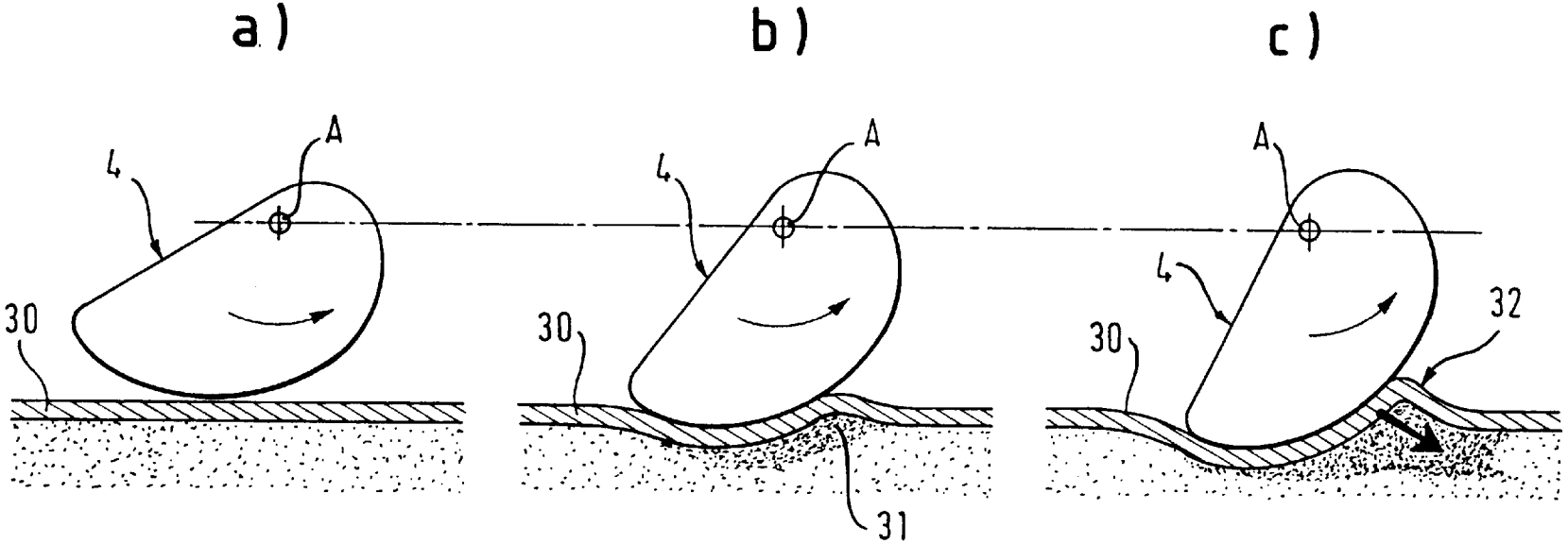
FIGS. 6*a–c* show a diagrammatic representation of the mode of action of the massage device according to the invention.

When using the massage head shown in FIG. 3, the person carrying out the treatment can generate the pump action described in FIG. 6 optionally in opposite directions, simply by turning the device about the axis A or an axis parallel thereto, and thus bringing either the portion 10 or the portion 11 into contact with the patient's skin. In the device from FIG. 1, this rotation is effected with the aid of the lever 52, and in the hand-held device from FIG. 2 by turning it with the free hand.

While the person carrying out treatment turns the device about the axis A, said person can also select the zone of the portion 10 or 11 which is to act on the skin of the patient. A zone of greater radius will be chosen, the thicker the muscle layer to be treated. A typical value for the movement amplitude of a point on the active surface is about 4 to 7 mm.

The oscillation frequency of the active surface can be set in a range of 5 to 25 Hz. In the case of the striated muscle, which with 40% body mass represents the largest organ of the human body, intrinsic oscillations dependent on functional status are known, for example muscle tremors for producing warmth in cold conditions, shaking in the case of disease or in the case of strenuous effort, for example when lifting weights. This tremor itself makes an active contribution to the flow of fluid through the tissue as it rhythmically compresses vessels, nerves and connective tissue spaces and, where the valve system of the veins and lymph vessels is intact, ensures accelerated transport of fluid away from the tissue. In order stimulate and to make use of this endogenous disposition to tremor and the associated improved supply of the tissues, the massage device according to the invention expediently operates at the same frequency, which is in the range of 8 to 12 Hz.

Figure 7:
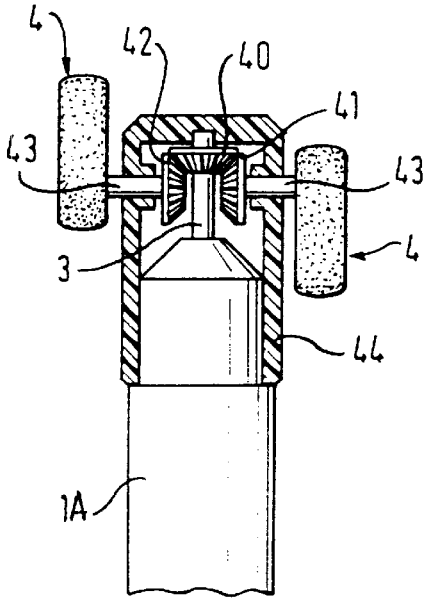
FIGS. 7 and 8 each show a further development of the massage device according to the invention.

FIG. 7 shows a further development of the massage device according to the invention. Housing 1A and power supply are the same as in the device shown in FIG. 2. Instead of a massage head, the shaft 3 in the further development supports a conical gear wheel 40 which engages with two further conical shafts 41 and 42 and drives these in opposite directions. The conical shafts 41, 42 are supported by second shafts 43 which are mounted so as to rotate in a cap 44 placed on the housing 1A and which, at their ends emerging from the cap 44, each support a massage head 4. These massage heads move in counter phase and thus, in addition to the pressure and displacement effect described with reference to FIG. 5, exert a shearing force on the tissue lying between them. This further development is particularly suitable for paradorsal treatment.

Figure 8:
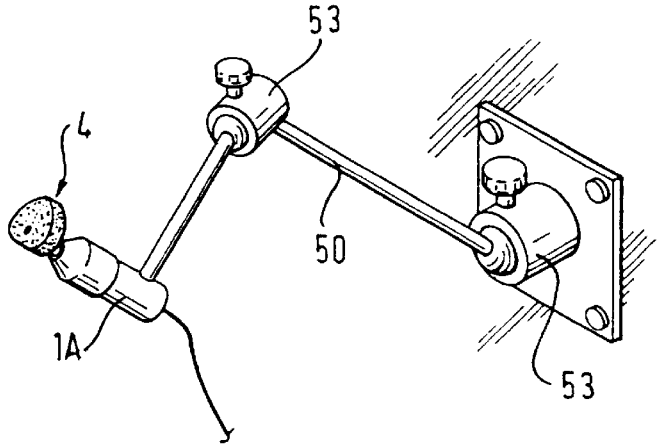

FIG. 8 shows a second further development. In this, the housing 1A is supported by a support arm 50 with a plurality of lockable articulations which allow the massage head 4 to be placed in largely any desired spatial position. This further development is particularly suitable for self-treatment of body areas which are difficult to access without tensing the muscles, which is detrimental to the success of the treatment, for example the back of the neck or the area of the thoracic spine.

Figure 9:
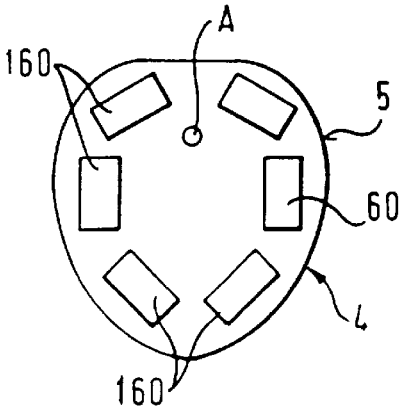
FIGS. 9 and 10 show further variants of massage heads.
Figure 10:
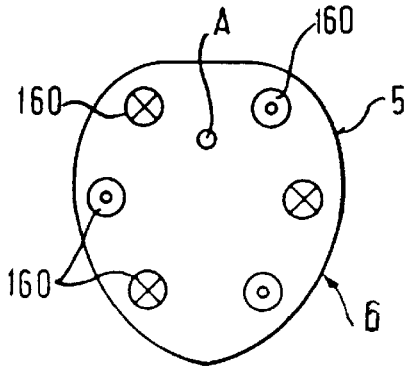

FIGS. 9 and 10 show a third further development concerning the massage head 4. In the massage head shown in FIG. 9, in cross section perpendicular to the axis A, permanent magnets 60 are incorporated with a field axis running essentially parallel to the active surface 5 in the plane of the section. These magnets 60 induce an electromagnetic alternating field in the treated tissue, which field oscillates with the oscillation frequency of the massage head and induces electrical potentials in the tissue.

In the massage head according to FIG. 10, the magnets 160 are incorporated with a field axis parallel to the pivot axis A and with in each case alternating orientation. The effect of this massage head on the tissue corresponds to that of the head from FIG. 9. The alternating fields act in particular on the nerve paths in the tissue and thus act in particular on the nerve-controlled natural disposition of the muscle tissue toward tremor. This is expected to provide an additional increase of the fluid exchange in the tissue which is achieved with the massage device according to the invention.

The present invention allows for many variants not described in detail here. Thus, the massage head can be circular (with the pivot axis offset toward the center of the circle), oval or elliptical, and it can have Archimedean or logarithmic spiral portions and combinations of circular, elliptical, rectilinear or spiral portions, etc. To adapt to different applications, a plurality of massage heads can be provided which are secured releasably on the device in such a way that they can be exchanged, for example by screwing onto the shaft or by means of a bayonet mechanism. Power can be supplied to the massage head via an accumulator or batteries incorporated in the housing instead of via the supply cable; an on/off switch and a control for the oscillation frequency can be provided on the housing or, if appropriate, on the power supply unit.

What is claimed is:

1. A massage device comprising:

an active surface for contacting tissue to be treated, a means for driving the active surface in an oscillating pivoting movement about a single axis, wherein the active surface has, in cross section, different radii perpendicular to the axis in different directions, each of said different radii increasing along at least one portion of the active surface so as to form different zones, and the active surface further being able to be rotated about the axis at an angle so as to enable said different zones of the active surface to come into contact with the tissue, and wherein the radii of the active surface are between 3 and 100 mm, wherein the means for driving the active surface oscillates the active surface with a frequency in the range of 5 to 25 Hz; and wherein the active surface has one area near the axis and one area distant from the axis, which areas are connected along the active surface by portions having a changing radius.

2. The massage device as claimed in claim 1, wherein the angle of rotation of the active surface about the axis is greater than an amplitude of the pivoting movement.

3. The massage device as claimed in claim 1, wherein the radius of the area near the axis is in the range of 3 to 10 mm, and the radius of the area distant from the axis is in the range of 15 to 100 mm.

4. The massage device as claimed in claim 3, wherein the radius of the area distant from the axis is in the range of 20 to 50 mm.

5. The massage device as claimed in claim 1, wherein the active surface is mirror-symmetrical in relation to a plane passing through the areas near and distant from the axis.

6. The massage device as claimed in claim 1, wherein said at least one portion of the active surface is in substantially the form of a spiral in section perpendicular to the axis.

7. The massage device as claimed in claim 1, further including a housing which can be guided in the hand and in which a motor is arranged for driving the active surface in the pivoting movement, the housing being able to be rotated by hand about the axis.

8. The massage device as claimed in claim 7, further including a head defining the active surface and releasably connected to the housing.

9. The massage device as claimed in claim 1, wherein the active surface is made of a resilient material.

10. The massage device as claimed in claim 1, wherein the oscillating pivoting movement of the active surface about the axis has an amplitude of 4 to 7 mm.

11. The massage device as claimed in claim 1, further including a second active surface, each active surface oscillating with respect to the other.

12. The massage device as claimed in claim 1, wherein the massage device is adapted for treating muscle tissue and connective tissue of warm-blooded beings.

13. The massage device as claimed in claim 1, wherein the means for driving the active surface oscillates the active surface with a frequency in the range of 8 to 12 Hz.

14. The massage device as claimed in claim 1, wherein the oscillating pivoting movement of the active surface about the axis has an amplitude of 7 mm or less.

15. A massage device comprising:

an active surface for contacting tissue to be treated, a means for driving the active surface in an oscillating pivoting movement about a single axis, wherein the active surface has, in cross section, different radii perpendicular to the axis in different directions, each of said different radii increasing along at least one portion of the active surface so as to form different zones, and the active surface further being able to be rotated about the axis at an angle so as to enable said different zones of the active surface to come into contact with the tissue, and wherein the radii of the active surface are between 3 and 100 mm, wherein the means for driving the active surface oscillates the active surface with a frequency in the range of 5 to 25 Hz; and wherein the active surface has only one area near the axis and only one area distant from the axis, which areas are connected along the active surface by portions having a changing radius.

* * * * *